US007347021B1

(12) United States Patent
Jones

(10) Patent No.: US 7,347,021 B1
(45) Date of Patent: Mar. 25, 2008

(54) FIREARM ACTION OR RECEIVER

(76) Inventor: C. Barry Jones, 4 Riverside Dr., Bay St. Louis, MS (US) 39520

( * ) Notice: Subject to any disclaimer, the term of this patent is extended or adjusted under 35 U.S.C. 154(b) by 172 days.

(21) Appl. No.: 11/401,563

(22) Filed: Apr. 11, 2006

(51) Int. Cl.
*F41A 3/64* (2006.01)
*F41A 5/16* (2006.01)

(52) U.S. Cl. ..... 42/10; 89/161

(58) Field of Classification Search ..... 42/2, 42/10, 69.01, 75.02, 75.03, 75.1, 77; 89/161
See application file for complete search history.

(56) References Cited

U.S. PATENT DOCUMENTS

| | | | | | |
|---|---|---|---|---|---|
| 92,799 | A * | 7/1869 | Delessize | 42/10 |
| 650,829 | A * | 6/1900 | Evans | 42/10 |
| 2,144,091 | A * | 1/1939 | Varona | 42/10 |
| 2,699,006 | A * | 1/1955 | Maerk | 42/10 |
| 2,835,998 | A * | 5/1958 | Maerk | 42/10 |
| 3,088,378 | A * | 5/1963 | Boudreau | 89/161 |
| 3,483,648 | A * | 12/1969 | Speckhart | 42/10 |
| 3,680,241 | A * | 8/1972 | Ramsay | 42/10 |
| 3,757,447 | A * | 9/1973 | Rowe | 42/51 |
| 3,892,082 | A * | 7/1975 | Domhan | 42/11 |
| 4,028,994 | A * | 6/1977 | Ferluga | 89/161 |
| 4,447,977 | A | 5/1984 | Holngren | |
| 4,897,949 | A * | 2/1990 | Whiteing | 42/10 |
| 5,678,341 | A * | 10/1997 | Kahnke | 42/51 |
| 5,939,659 | A * | 8/1999 | Dobbins | 89/161 |
| 6,405,631 | B1 * | 6/2002 | Milek | 89/139 |
| 6,964,220 | B1 * | 11/2005 | Lavin | 89/159 |
| 7,137,217 | B2 * | 11/2006 | Olson et al. | 42/15 |
| 7,231,864 | B2 * | 6/2007 | Ratti | 89/161 |

* cited by examiner

*Primary Examiner*—Bret Hayes
(74) *Attorney, Agent, or Firm*—George L. Williamson

(57) ABSTRACT

Apparatus 10 discloses a receiver body 12 along with a trigger 14 for activating the firing mechanism and a lever 16 for opening the breech assembly to allow access to the chamber for receiving the shell/cartridge 56 at the rear of the barrel 18. FIG. 1 shows the breech block 28 and barrel 18 closed and FIG. 2 shows the breech block 28 and barrel 18 open. Also shown is the action bar 20 having a front portion for contacting the rear of the firing pin 22 and forcing the firing pin forward so as to contact the primer 55 of the shell/cartridge 56. The firing pin 22 has a firing pin spring 26 thereon which is mounted in a hole in the breech block 28. The action bar 20 is supported by upper and lower supports 30 near its front end along with upper and lower support pins 31 which also act as a rear spring stop near its mid-section having main spring 24 and front spring stop 25 thereon. Also shown on the action bar is internal, transverse slot 38 and notch 48 on its bottom surface. The cocking thumb piece 32 is shown for cocking the cocking links 34, 36 which operate on a fulcrum post 46 wherein the lower link 36 moves slidably in slot 38. Also shown is the sear 40 which pivots on sear pivot 41 and a trigger-sear spring 42. On the upper end of trigger 14 is a trigger link 44. Also shown is the trigger 14 which moves on pivot pin 54. The trigger 14 also has a tab 50 on its upper rear side.

11 Claims, 3 Drawing Sheets

FIREARM ACTION OR RECEIVER

BACKGROUND OF THE INVENTION

1. Field of the Invention

The present invention generally relates to firearms and, more particularly, is concerned with an apparatus for a firing pin mechanism for a firearm.

2. Description of the Prior Art

Mechanisms for firing pins have been described in the prior art. However, none of the prior art discloses the unique features of the present invention.

U.S. Pat. No. 4,447,977 to Holngren dated May 15, 1984, disclosed a multifaceted firing device.

While these mechanisms may be suitable for the purposes for which they were designed, they would not be as suitable for the purposes of the present invention, as hereinafter described.

SUMMARY OF THE INVENTION

The present invention comprises a receiver body along with a trigger for activating the firing mechanism and a lever or other means for opening the breech to allow access to the chamber for receiving the shell/cartridge at the rear of the barrel. Also shown is the action bar having a front portion co-aligned with and for contacting the rear of the firing pin and forcing the firing pin forward so as to contact the primer of the shell/cartridge. The firing pin has a firing pin spring thereon which is mounted in a hole in the breech block. The action bar is supported by upper and lower supports near its front end along with upper and lower support pins which also act as a rear spring stop near its mid-section having main spring and front spring stop thereon. Also shown on the action bar is internal, transverse slot and a notch on its bottom surface. The cocking thumb piece is shown for cocking the cocking links which operate on a fulcrum post wherein the lower link moves slidably in the slot. Also shown is the sear which pivots on a sear pivot and a trigger-sear spring. On the upper end of the trigger is a trigger link. Also shown is the trigger which moves on a pivot pin. The trigger also has a tab on its upper rear side.

An object of the present invention is to provide a firing mechanism that is simple to use.

A further object of the present invention is to provide a firing mechanism that is safe.

A further object of the present invention is to provide a firing mechanism that is simple and relatively economical to produce having relatively few moving parts.

A further object of the present invention is to provide a firing mechanism that can be used for different types of firearms including a muzzle loader or center fire rifles or shotguns being single or double barreled.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
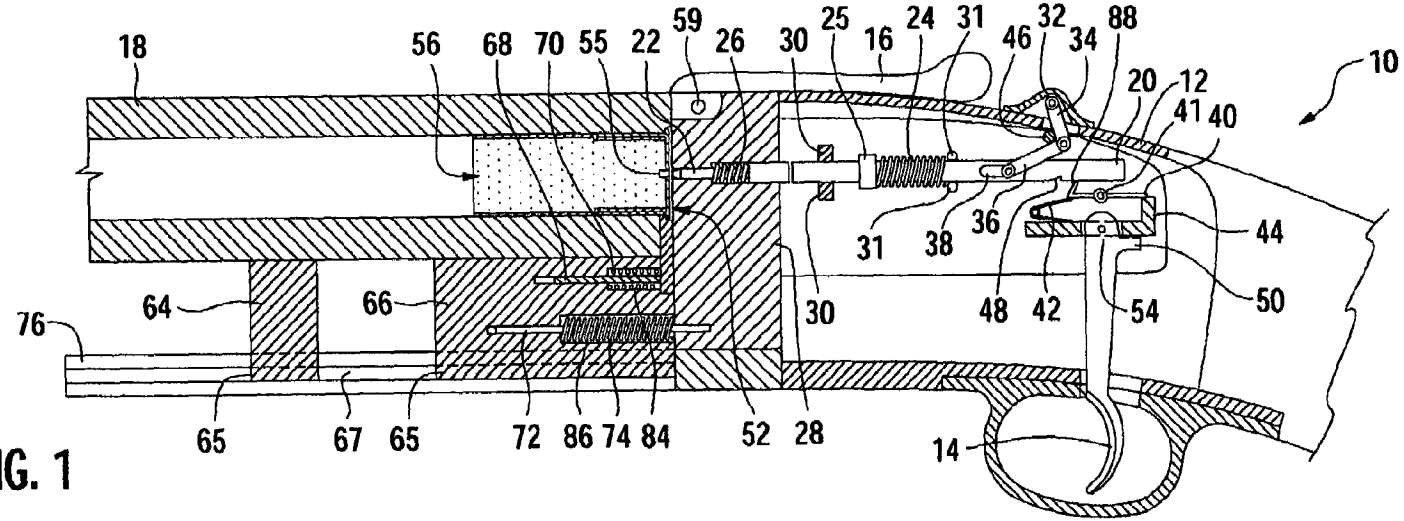
FIG. 1 is a section view of portions of the present invention.

With regard to reference numerals used, the following numbering is used throughout the drawings.

10 present invention
12 receiver body
14 trigger
16 lever
18 barrel
20 action bar
22 firing pin
24 main spring
25 main spring stop
26 firing pin spring
28 breech block
30 support
31 support pins
32 cocking thumb piece
34 cocking link
36 cocking link
38 slot
40 sear
41 sear pivot
42 trigger-sear spring
44 trigger link
46 fulcrum post
48 notch
50 tab
52 face of breech
54 pivot pin
55 primer
56 shell/cartridge
58 extension lug
59 pin for extension lug
60 slot
61 hole
62 extractor
64 front barrel support
65 flange
66 rear barrel support
67 track
68 extractor pin
70 extractor spring
72 barrel pin
74 barrel spring
76 barrel support member
78 slot

80 stop pin
82 stop pin lever
84 extractor hole
86 barrel spring hole
88 front flange of sear

DETAILED DESCRIPTION OF THE PREFERRED EMBODIMENT

Turning now descriptively to the drawings, in which similar reference characters denote similar elements throughout the several views, FIGS. 1 through 6 illustrate the present invention wherein a firing pin mechanism for a firearm is disclosed.

Figure 2:
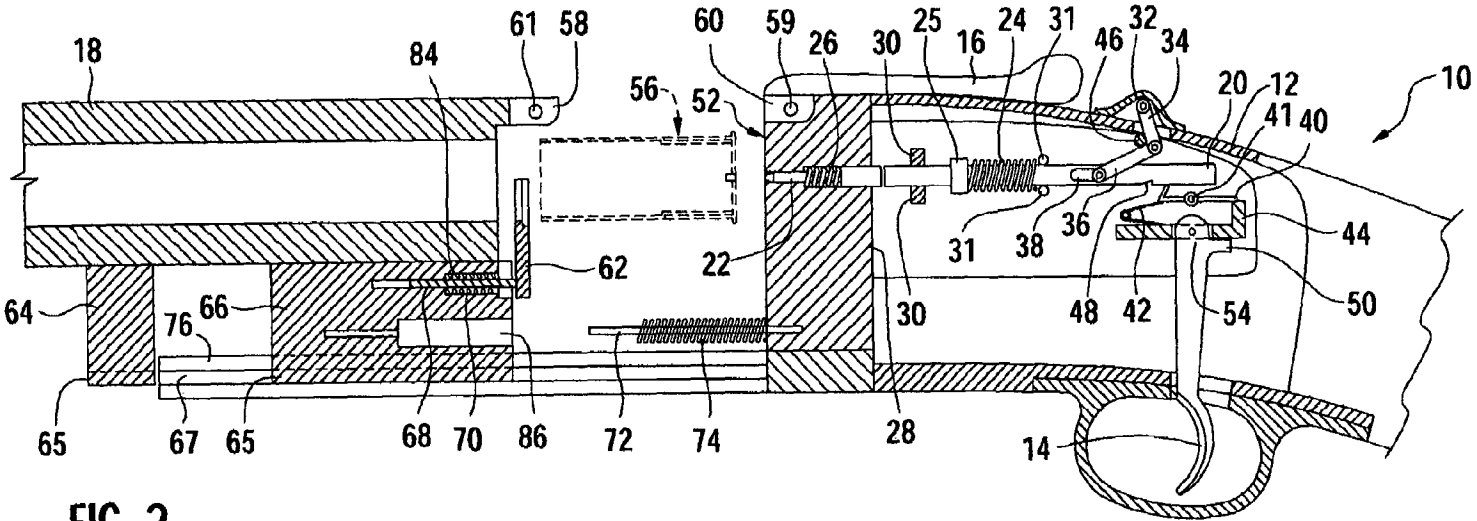
FIG. 2 is a section view of the present invention.

Turning to FIGS. 1 and 2, therein are shown the present invention 10 comprising a receiver body 12 along with a trigger 14 for activating the firing mechanism and a lever 16 for opening the breech assembly to allow access to the chamber for receiving the shell/cartridge 56 at the rear of the barrel 18. FIG. 1 shows the breech block 28 and barrel 18 closed and FIG. 2 shows the breech block 28 and barrel 18 open. Also shown is the action bar 20 having a front portion for contacting the rear of the firing pin 22 and forcing the firing pin forward so as to contact the primer 55 of the shell/cartridge 56. The firing pin 22 has a firing pin spring 26 thereon which is mounted in a hole in the breech block 28. The action bar 20 is supported by upper and lower supports 30 near its front end along with upper and lower support pins 31 which also act as a rear spring stop near its mid-section having main spring 24 and front spring stop 25 thereon. Also shown on the action bar is internal, transverse slot 38 and notch 48 on its bottom surface. The cocking thumb piece 32 is shown for cocking the cocking links 34, 36 which operate on a fulcrum post 46 wherein the lower link 36 moves slidably in slot 38. Also shown is the sear 40 which pivots on sear pivot 41 and a trigger-sear spring 42. On the upper end of trigger 14 is a trigger link 44. Also shown is the trigger 14 which moves on pivot pin 54. The trigger 14 also has a tab 50 on its upper rear side. Also shown on the breech block 28 is the front face of the breech 52. The barrel 18 is secured to the breech 28 by an extension lug 58 having an internal transverse hole 61 therein which receives the extension lug pin 59 therein as the extension lug is inserted into the slot 60 on the top portion of the breech block 28 so that the breech can be opened and closed by lever 16. Also shown is the cartridge/shell 56 extractor 62 which comprises an extractor pin 68 along with an extractor spring 70. The barrel 18 comprises a front barrel support 64 and a rear barrel support 66 which each have a lower flange 65 thereon which slides to the front and rear in slot or track 67 of lower barrel support member 76 in response to pressure from the barrel pin 72 and barrel spring 74 which occurs after the lever 16 is operated to free the barrel 18 from the breech block 28. Both pin and spring 68, 70 and 72, 74 are contained in holes in the rear of the rear barrel support 66.

In operation, the gun of the present invention 10 is opened via the conventional top lever 16 and a cartridge/shell 56 is inserted into the barrel 18, the thumb piece 32 is cocked by pushing it forward which pulls the action bar 20 to the rear compressing the main spring 24 and engaging the front flange 88 of sear 40 into notch 48 on the action bar (the trigger/sear spring 42 holds the sear 40 front nose flange in the notch 48 and holds the trigger 14 against the rear of the sear arm 40). To fire the gun, the trigger 14 is pulled to the rear wherein it pivots on its pin 54 causing tab 50 to move link 44 which presses upward on the rear of sear arm 40 so that the sear pivots on its pin 41 and the sear nose flange 88 disengages from the notch 48 on the action bar 20 whereby the main spring 24 decompresses driving the action bar towards the barrel 18 wherein action bar 20 strikes the firing pin 22 and the firing pin strikes the primer 55 in the cartridge 56 and the gun fires.

Figure 3:
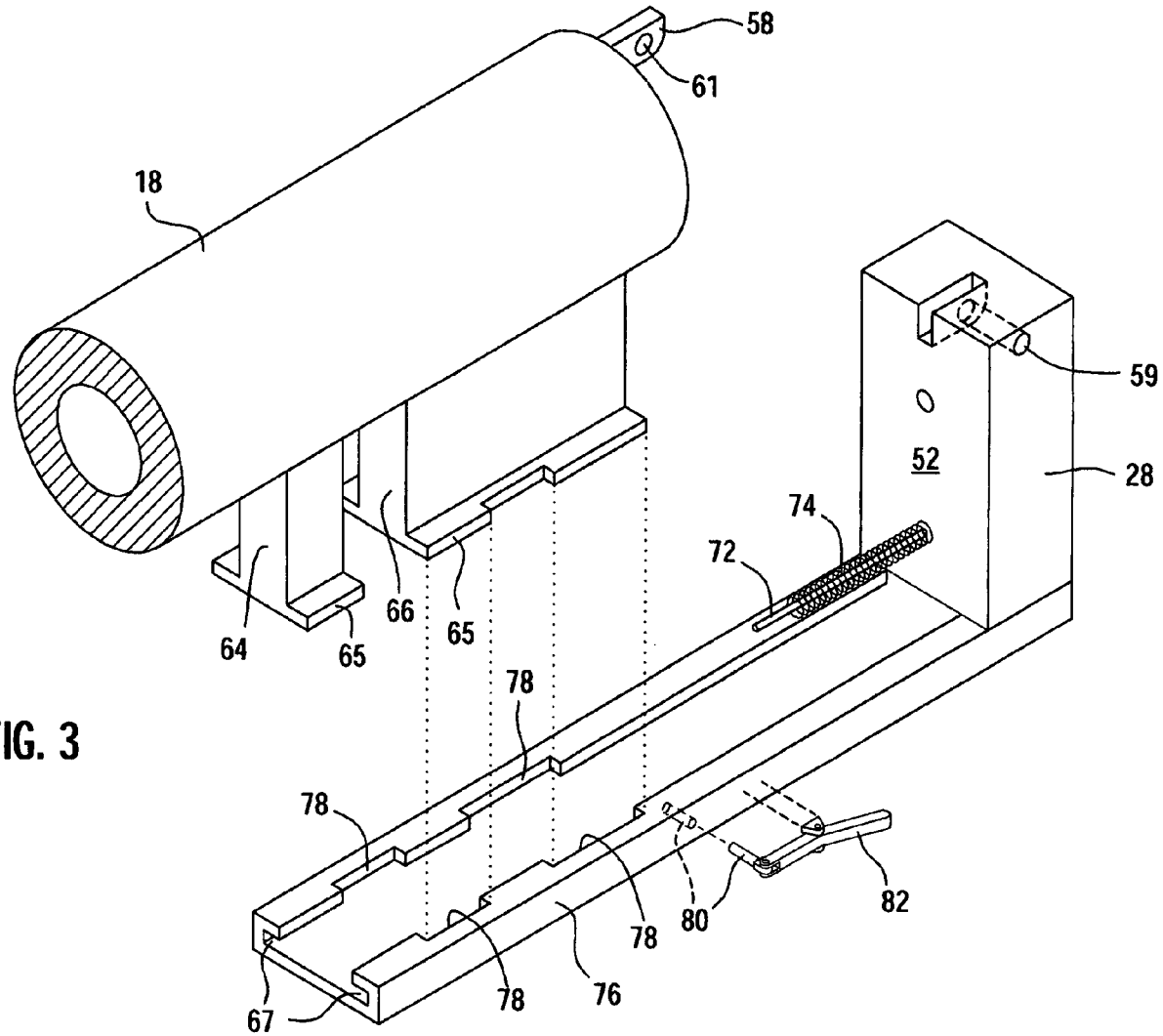
FIG. 3 is a perspective view of portions of the present invention.

Turning to FIG. 3, therein is shown the barrel 18 along with the extension lug 58 having a hole 61 therein for receiving pin 59 on its rear and the front face 52 of the breech 28 along with the front barrel support 64 and rear barrel support 66 each having a flange 65 on its lower end which flange travels to the front and rear in track 67 which is disposed in the forward extension portion of the barrel support track member 76 which is disposed to the front and underside of the breech block 28. It should be clear that the barrel 18 can slide to the front and rear in the barrel support member 76 as the lever 16 (not shown, see FIGS. 1 and 2) is operated wherein the barrel moves in response to the barrel spring 74 on barrel pin 72 as the lever 16 is operated which spring 74 forces the barrel forward which allows flange 65 to slide in track 67 of the track of the barrel support member 76 until the front of rear flange 65 contacts stop pin 80 operated by pivotable lever 82. If lever 82 is operated the pin 80 is moved into an outward position so as to allow flange 65 to move forward in track 67 to a point where flanges 65 align with mating enlarged slot areas 78 thereby allowing barrel 18 to be removed upwardly from support member 76.

Figure 4:
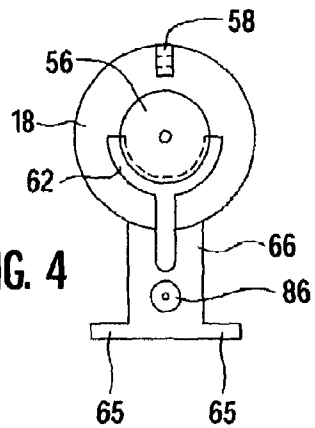
FIG. 4 is a rear elevation view of the barrel of the present invention.

Turning to FIG. 4, therein are shown the barrel 18, shell/cartridge 56, extractor 62, rear barrel support 66, flanges 65, barrel spring hole 86, and extension lug 58.

Figure 5:
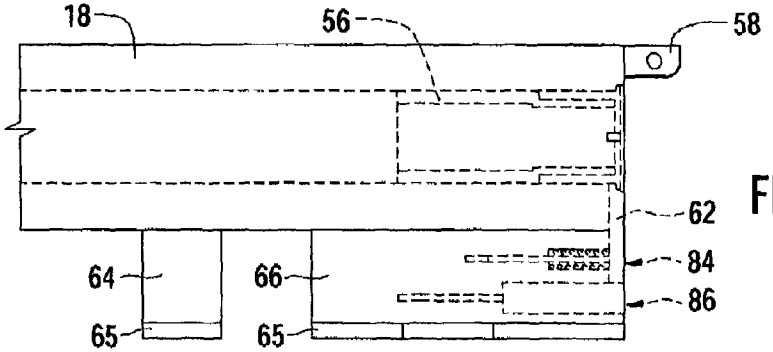
FIG. 5 is a side elevation view of portions of the present invention.

Turning to FIG. 5, therein are shown the barrel 18, shell/cartridge 56, extractor 62, extractor hole 84, barrel spring hole 86, extension lug 58, front and rear barrel supports 64, 66 and flanges 65.

Figure 6:
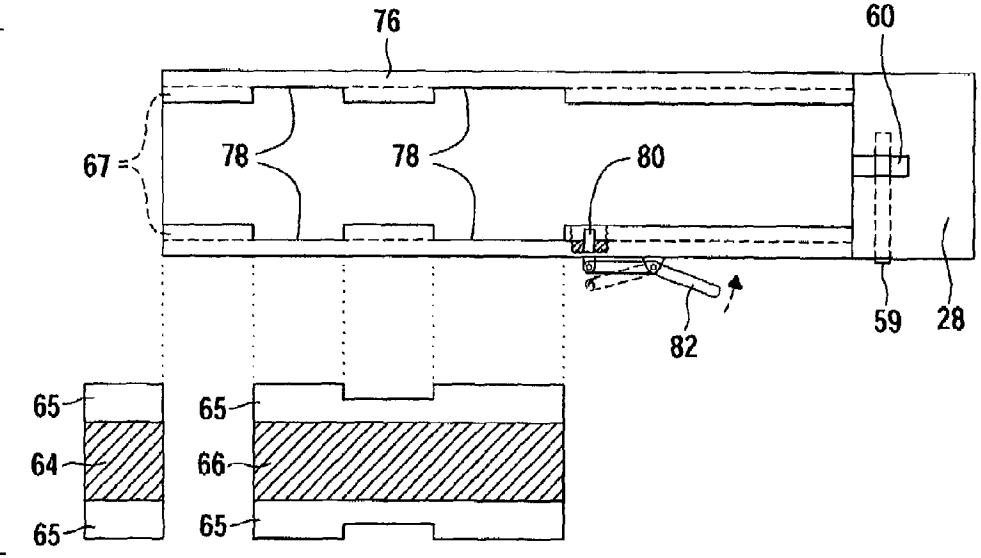
FIG. 6 is a plan view and section view of portions of the present invention.

Turning to FIG. 6, therein are shown the barrel support member 76, breech block 28, pin 59, slot 60, tracks 67, slot 78, stop pin 80, and pivotable lever 82 showing a related arrow to indicate the pivoting action. Also shown is a section view of the front and rear barrel supports 64, 66 showing how supports 64, 66 are removably insertable from support member 76. Flanges 65 are also shown.

In practice, the cocking sequence is the cocking thumb piece 32 is pushed forward so that the cocking links 34, 36 pivot against the fulcrum post 46 pulling the action bar 20 to the rear compressing the main spring 24. The nose 88 of sear 40 is pushed up into the action bar notch 48 where the main spring 24 compression pressure holds it in place. If cocking piece 32 is pulled back to the rear the bottom link pin 36 slides to the front of the slot 38.

In practice, the firing sequence is the trigger 14 is pulled wherein the tab 50 on the trigger pivots the rear of the trigger link 44 (FIG. 2) up thereby pushing against the rear end of the sear 40 to cause it to pivot upward. The front 88 of the sear 40 pivots down pulling the sear flange out of the notch 48 of the action bar 20 wherein the main spring 24 decompresses driving the action bar 20 forward to strike the firing pin 22. The firing pin 22 flies forward to strike the primer 55 and compresses the firing pin spring 26 whereby the gun fires and the firing pin spring the decompresses pushing the firing pin back to the unfired position. The firing pin 22 of the present invention 10 is a floating firing pin so that the action bar 20 should strike it only hard enough to overcome the tension on the firing pin spring 26. The action bar 20 should only be long enough to barely touch the firing pin 22 when the action bar is in the uncocked position and the firing pin is retracted from the firing pin hole.

I claim:

1. An apparatus for a firing pin mechanism for a firearm, comprising:

a) a barrel having front and rear ends and a top and bottom, a chamber for receiving a shell being disposed on said rear end, said chamber having top and bottom portions;

b) a breech block being disposed on the firearm contiguous to said rear end of said barrel, said breech block having top and bottom ends, first and second sides and front and rear surfaces, said breech block having a first hole therein, said first hole being longitudinally aligned with said chamber, a firing pin being disposed in said first hole, said firing pin having front and rear ends, a firing pin spring being disposed on said firing pin to bias said firing pin rearwardly away from said chamber;

c) a receiver being disposed adjacent said rear of said breech block for containing portions of the apparatus, said receiver having a top surface;

d) an action bar having front and rear ends, first and second sides and top and bottom surfaces being slidably disposed in said receiver of a firearm so that said front end of said action bar can contact said rear end of said firing pin, wherein the central axis of said action bar is aligned with the central axis of said firing pin, said action bar having a transverse slot therein and a notch thereon, said slot having front and rear surfaces and said notch being disposed on said bottom of said action bar, wherein said action bar has an uncocked position and a cocked position;

e) a main spring having first and second ends being disposed around said action bar, wherein said action bar is biased toward said firing pin by said main spring when said action bar is in said cocked position;

f) a cocking piece being slidably disposed on said receiver of the firearm so that said cocking piece can be moved back and forth between a first position wherein said action bar is uncocked and a second position wherein said action bar is cocked, wherein said cocking piece is adapted for connection to said action bar so that said action bar can be moved rearwardly to said cocked position;

g) a trigger being pivotally disposed in said receiver adjacent to and beneath said action bar, said trigger having top and bottom ends and front and rear surfaces, a tab being disposed on said top end of said rear surface of said trigger, wherein said bottom of said trigger is adapted for being held by a finger of a user; and, h) a sear having front and rear ends and top and bottom surfaces being pivotally disposed in said receiver, wherein when said action bar is moved rearwardly to said cocked position in response to said cocking piece, said sear being adapted to contact said action bar so as to secure said action bar in said cocked position, wherein when said bottom end of said trigger is pulled to the rear by a user said trigger is adapted to move said sear to a position where said action bar is released from said sear and said action bar is driven forward in response to said main spring so that said front end of said action bar strikes said rear end of said firing pin thereby driving said front end of said firing pin into the primer of a shell so that the firearm is thereby fired.

2. The apparatus of claim 1, further comprising a first cocking link connecting said cocking piece to said action bar.

3. The apparatus of claim 2, further comprising a second cocking link connecting said cocking piece to said action bar, wherein said first and second cocking links are pivotally connected to each other and pivot about a fulcrum post, wherein an end of said cocking links connect to said transverse slot in said action bar so that said end can slide in said transverse slot.

4. The apparatus of claim 3, wherein said cocking piece is disposed on said top of said receiver of the firearm so that said cocking piece can be operated by a thumb of a user.

5. The apparatus of claim 4, wherein said sear has a flange disposed on its front end so that said flange can contact said notch on said action bar so as to secure said action bar in said cocked position.

6. The apparatus of claim 4, a trigger link having front and rear ends being disposed in pivotable relationship to said trigger, wherein when said trigger is pulled to the rear by a user said tab on said trigger moves said rear end of said trigger link upwardly so as to contact said rear end of said sear so as to cause said flange of said sear to move away from said action bar to a position where said action bar is released from said sear.

7. The apparatus of claim 6, further comprising a trigger—sear spring having first and second ends being disposed between said sear and said trigger so that said first end of said spring biases said flange of said sear toward said action bar.

8. The apparatus of claim 7, further comprising a second support being disposed in said receiver for supporting said action bar, wherein said second support is disposed adjacent said front end of said action bar.

9. The apparatus of claim 8, further comprising a first support being disposed in said receiver for supporting said action bar, wherein said first support is disposed adjacent said middle of said action bar.

10. The apparatus of claim 9, further comprising a sear pivot being disposed on said sear between said front and rear ends of said sear.

11. The apparatus of claim 10, further comprising a pivot pin being disposed on said top end of said trigger.

* * * * *